US012753751B2

(12) United States Patent
Narisawa et al.

(10) Patent No.: US 12,753,751 B2
(45) Date of Patent: Oct. 6, 2026

(54) COMPRESSOR

(71) Applicant: HITACHI INDUSTRIAL EQUIPMENT SYSTEMS CO., LTD., Tokyo (JP)

(72) Inventors: Nobuyuki Narisawa, Tokyo (JP); Ken Umeda, Tokyo (JP)

(73) Assignee: HITACHI INDUSTRIAL EQUIPMENT SYSTEMS CO., LTD., Tokyo (JP)

( * ) Notice: Subject to any disclaimer, the term of this patent is extended or adjusted under 35 U.S.C. 154(b) by 46 days.

(21) Appl. No.: 18/729,901

(22) PCT Filed: Nov. 14, 2022

(86) PCT No.: PCT/JP2022/042242
§ 371 (c)(1),
(2) Date: Jul. 18, 2024

(87) PCT Pub. No.: WO2023/243117
PCT Pub. Date: Dec. 21, 2023

(65) Prior Publication Data

US 2025/0116267 A1 Apr. 10, 2025

(30) Foreign Application Priority Data

Jun. 17, 2022 (JP) ..... 2022-098152

(51) Int. Cl.
*F04B 49/06* (2006.01)
*F04B 35/04* (2006.01)
(Continued)

(52) U.S. Cl.
CPC ..... *F04B 49/065* (2013.01); *F04B 35/04* (2013.01); *F04B 49/10* (2013.01); *F04B 49/03* (2013.01); *F04B 2203/0201* (2013.01)

(58) Field of Classification Search
CPC .. F04B 35/04; F04B 49/06–065; F04B 49/10; F04B 2203/0201; H02P 29/024–028; H02P 29/40
See application file for complete search history.

(56) References Cited

U.S. PATENT DOCUMENTS 3,863,110 A * 1/1975 Bauer, Jr. ..... F04D 27/0284 361/87
5,604,672 A * 2/1997 Yoshida ..... H02M 7/5395 318/811

(Continued)

FOREIGN PATENT DOCUMENTS

CN 108350872 A * 7/2018 ..... F25B 49/025
CN 108575115 B * 4/2022 ..... H02M 7/5387

(Continued)

OTHER PUBLICATIONS

International Search Report of PCT/JP2022/042242 dated Jan. 24, 2023.

*Primary Examiner* — Alexander B Comley
(74) *Attorney, Agent, or Firm* — MATTINGLY & MALUR, PC

(57) ABSTRACT

A compressor includes a compressor body, a motor, a current sensor that detects a current value of the motor, and a control device that controls the drive of the motor. The control device determines, through the current sensor, a current value of the motor at a point in time when a first time has elapsed from the start of the motor. The control device further determines a current value of the motor at a point in time when a second time, longer than the first time, has elapsed from the start of the motor. The control device makes a first notification corresponding to a first mode in a case where a first equation is met, and makes a second notification corresponding to a second mode in a case where a second equation is met.

5 Claims, 6 Drawing Sheets

(51) Int. Cl.
*F04B 49/03* (2006.01)
*F04B 49/10* (2006.01)

(56) References Cited

U.S. PATENT DOCUMENTS

| | | | | |
|---|---|---|---|---|
| 2013/0071258 | A1* | 3/2013 | Enomoto | F04D 27/001 417/44.1 |
| 2015/0345490 | A1* | 12/2015 | Bremeier | H02P 1/24 417/44.11 |
| 2020/0217895 | A1* | 7/2020 | Kanemaru | H02P 29/027 |
| 2020/0400138 | A1* | 12/2020 | Horimoto | F25D 11/00 |
| 2023/0280238 | A1* | 9/2023 | Kobori | G01R 23/02 73/865.8 |

FOREIGN PATENT DOCUMENTS

| | | | | | |
|---|---|---|---|---|---|
| JP | 63-212785 | A | | 9/1988 | |
| JP | 2000-205140 | A | | 7/2000 | |
| JP | 2008-200209 | A | | 9/2008 | |
| JP | 5767632 | B2 | * | 8/2015 | F04D 27/001 |
| JP | 2016505753 | A | * | 2/2016 | H02P 1/24 |
| JP | 2019-011733 | A | | 1/2019 | |
| JP | 6896090 | B2 | * | 6/2021 | H02P 29/0241 |
| JP | 2021127750 | A | * | 9/2021 | |
| JP | 2022028644 | A | * | 2/2022 | F04B 49/10 |
| JP | 7033401 | B2 | * | 3/2022 | |
| WO | 2019-176513 | A1 | | 9/2019 | |
| WO | WO-2021079469 | A1 | * | 4/2021 | H02H 7/1225 |

* cited by examiner

COMPRESSOR

TECHNICAL FIELD

The present invention relates to a compressor.

BACKGROUND ART

A compressor, which sucks in gas such as air, compresses the gas with a compressor body, and delivers high-pressure gas, is widely spread in the world, and in particular, a compressor of air is often used in factory lines and work sites as an air source for machine tools, press machines, air blows, and the like.

A compressor that detects a current value of a motor for driving the compressor and diagnose an abnormality of the compressor on the basis of a change in the current value has been known. For example, Patent Document 1 discloses a compressor that measures a drop time taken until a current (starting current) sharply raised at the start of the compressor decreases to a substantially no-load current (rated current of a motor), determines that the compressor is abnormal in a case where the measured drop time is equal to or larger than an upper limit of a specified time range, and displays, on a display device, that there is an abnormality in the compressor.

PRIOR ART DOCUMENT

Patent Document

Patent Document 1: JP-2000-205140-A

SUMMARY OF THE INVENTION

Problem to be Solved by the Invention

However, even if there is no abnormality in the compressor itself, there is a case where a voltage drop occurs due to an abnormality in a power supply system, the starting torque decreases, and the drop time taken until the starting current decreases to the substantially no-load current is equal to or larger than the upper limit of the specified time range. In the compressor of Patent Document 1, even if the drop time taken until the starting current decreases, due to the abnormality in the power supply system, to the substantially no-load current is equal to or larger than the upper limit of the specified time range as described above, it cannot be determined that there is no abnormality in the compressor but there is an abnormality in the power supply system, and it is finally determined that there is an abnormality in the compressor.

An object of the present invention is to provide a compressor that can discriminate an abnormality of a compressor from an abnormality of a power supply system on the basis of a change in a current value of a motor for driving the compressor.

Means for Solving the Problem

In order to achieve the above object, the present invention includes a compressor body that compresses gas, a motor that drives the compressor body, a current sensor that detects a current value of the motor, and a control device that controls the motor, and the control device is configured to compute, through the current sensor, a current value $I_1$ of the motor at a point in time when first time has elapsed from a start of the motor and a current value $I_2$ of the motor at a point in time when second time longer than the first time has elapsed from the start of the motor, and make a notification in a different mode between a case where the following equation (1) is established and a case where the following equation (2) is established for a first threshold value $I_{1limit}$ that is smaller than the current value obtained at the start of the motor and larger than a rated current value of the motor and a second threshold value $I_{2limit}$ that is smaller than the first threshold value $I_{1limit}$ and larger than the rated current value of the motor.

$$I_1 < I_{1limit} \text{ and } I_2 > I_{2limit} \quad (1)$$

$$I_1 > I_{1limit} \text{ and } I_2 > I_{2limit} \quad (2)$$

Advantages of the Invention

According to the present invention, an abnormality of the compressor and an abnormality of the power supply system can be discriminated from each other by comparing the current value $I_1$ of the motor at a point in time when the first time has elapsed from the start of the motor for driving the compressor and the current value $I_2$ of the motor at a point in time when the second time longer than the first time has elapsed from the start of the motor with the threshold values $I_{1limit}$ and $I_{2limit}$, respectively. Problems, configurations, and effects other than those described above will be clarified by the following description of embodiments.

MODES FOR CARRYING OUT THE INVENTION

Figure 1:
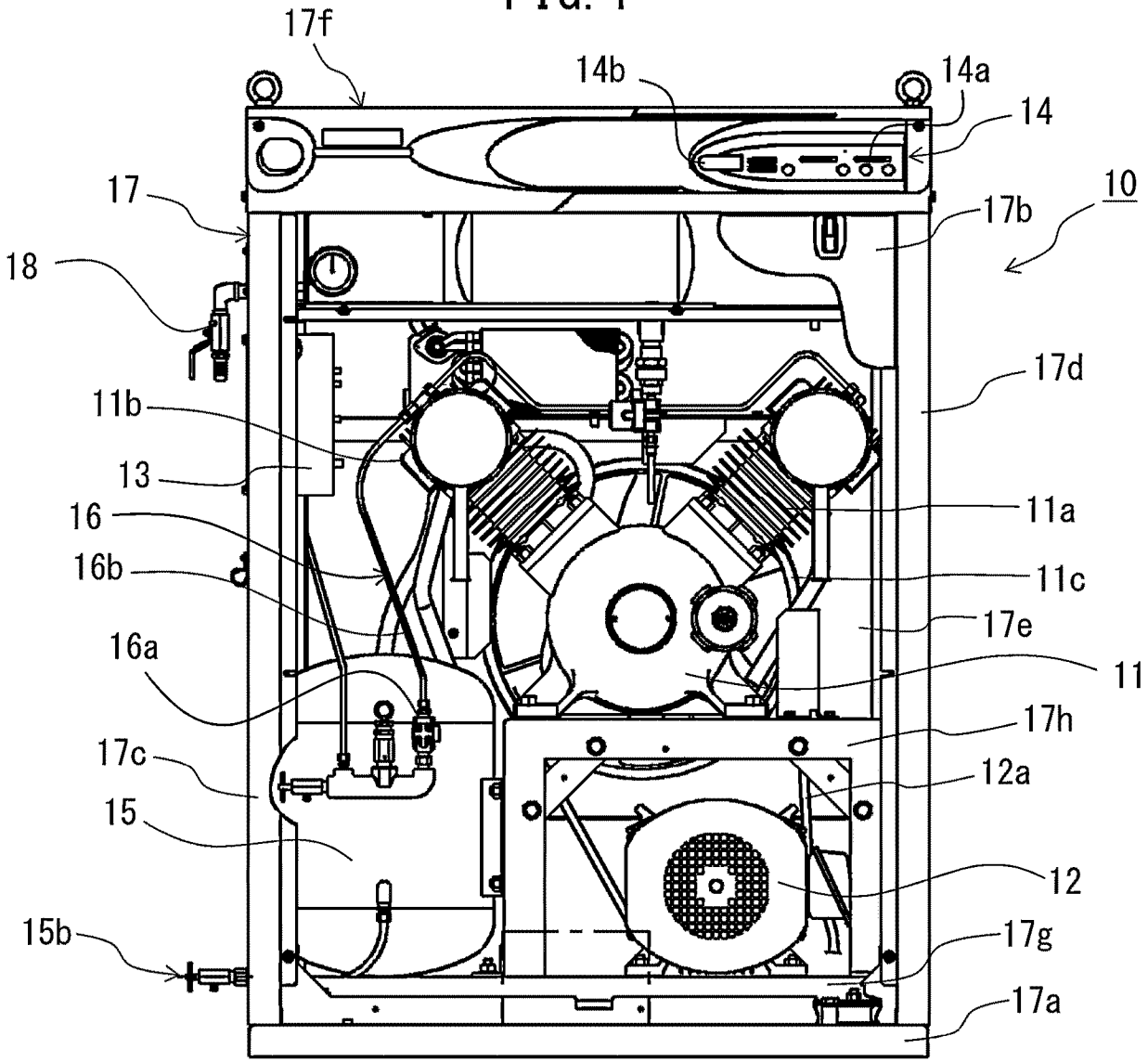
FIG. 1 is a front view in which a part of a front panel is seen through in a compressor according to a first embodiment of the present invention.

Hereinafter, a configuration and an operation of a compressor according to first to fifth embodiments of the present invention will be described using the drawings. It should be noted that the same reference characters indicate the same parts in each drawing.

First Embodiment

FIG. 1 is a front view in which a part of a front panel is seen through in a compressor 10 according to the first embodiment of the present invention. The compressor 10 according to the present embodiment is, for example, a reciprocating-type air compressor that compresses air by reciprocating a piston.

As depicted in FIG. 1, the compressor 10 is provided with a compressor body 11 for sucking in and compressing air, a motor 12 for driving the compressor body 11, an electromagnetic switch 13 for starting and stopping the motor 12 and for performing overload protection, a control device 14 for controlling the compressor 10, a tank 15 for storing compressed air, an unloader device 16 for reducing the starting load of the compressor body 11 in accordance with a command from the control device 14, a housing 17 for housing these devices, and a stop valve 18 for opening and closing a pipe for delivering the compressed air stored in the tank 15 to the outside of the compressor 10.

The compressor body 11 is a device that reciprocates a piston, sucks air into a cylinder 11*a* for compression, and delivers the compressed air to the tank 15. The compressor body 11 is provided with the cylinder 11*a* and a cylinder head 11*b* (see FIGS. 2 and 3).

Figure 4:
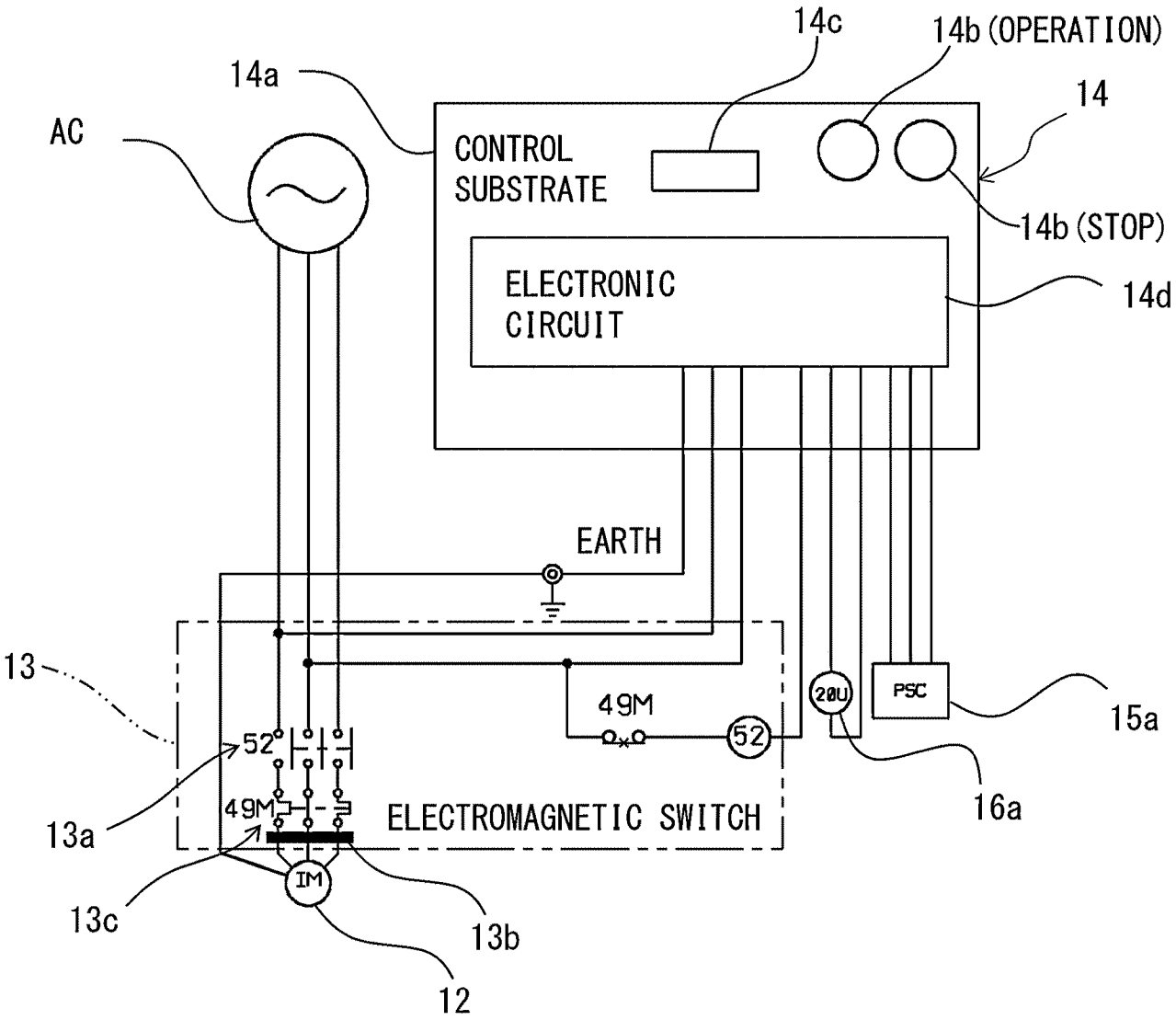
FIG. 4 is a control circuit diagram of the compressor according to the first embodiment of the present embodiment.

The motor 12 is, for example, an inductance motor, and is connected to a power supply AC through the electromagnetic switch 13 (see FIG. 4). When the motor 12 is driven, a pulley fixed to an output shaft of the motor 12 rotates, through a timing belt 12*a*, a pulley 11*c* fixed to a crankshaft of the compressor body 11, to reciprocate the piston.

Details of the electromagnetic switch 13 for starting and stopping the motor 12 and for performing overload protection and the control device 14 for controlling the compressor 10 will be described later.

The tank 15 is a device for storing the compressed air, and provides the compressed air to an apparatus of a customer by leveling the pulsation of the compressed air delivered from the compressor body 11. The tank 15 is provided with a pressure sensor 15*a* (see FIG. 4), which will be described later. In addition, a drain discharge device 15*b* for discharging liquid accumulated in the tank 15 to the outside is provided at a lower part of the tank 15.

Figure 3:
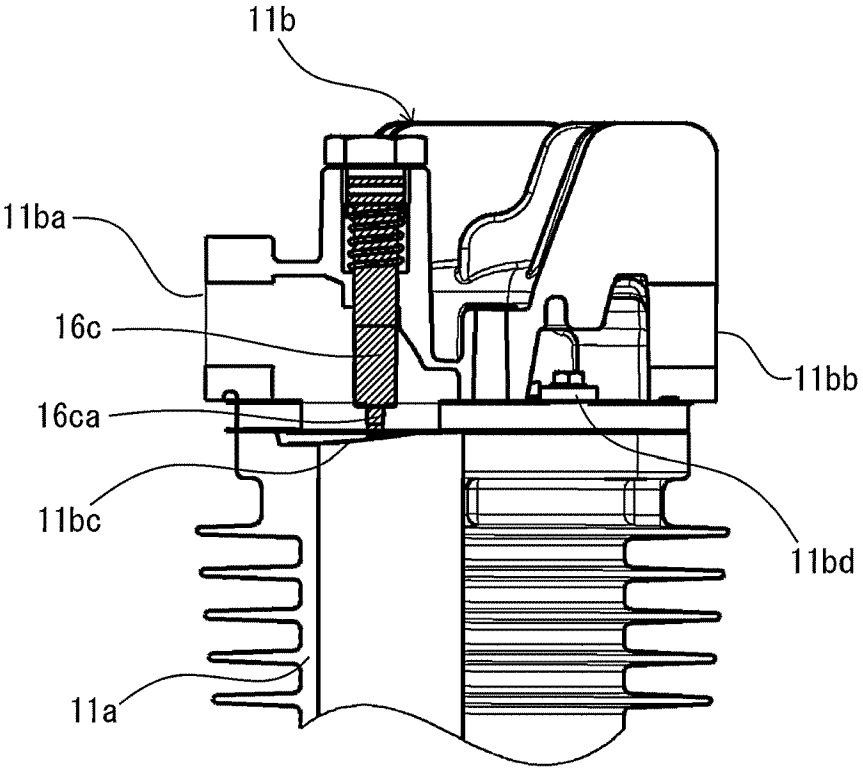
FIG. 3 is a partial cross-sectional view of the compressor body in a loaded state.
Figure 2:
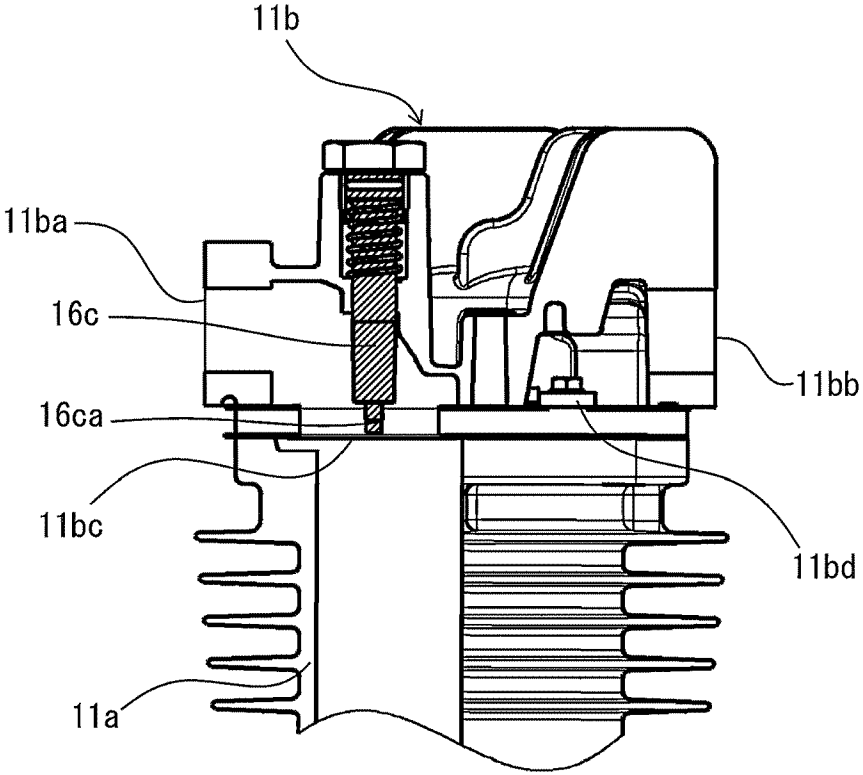
FIG. 2 is a partial cross-sectional view of a compressor body in an unloaded state.

The unloader device 16 is a device for bringing the compressor body 11 into a no-load state (unloaded state), and is provided with a three-way solenoid valve 16*a*, an unloader pipe 16*b*, and an unloader piston 16*c* (see FIGS. 2 and 3). The unloader pipe 16*b* and an unloader piston 16*c* will be described later.

The three-way solenoid valve 16*a* is a solenoid valve that switches a portion in communication with an unloader pipe 16*b* to one of the tank 15 and the outside air in accordance with a command from the control device 14.

The housing 17 is a plurality of substantially plate-like members covering the compressor 10 from six sides, and has a base 17*a*, a front panel 17*b*, a left panel 17*c*, a right panel 17*d*, a rear panel 17*e*, and an upper panel 17*f*.

A trestle 17*g* is fixed on the base 17*a* through a vibration-proof rubber. The motor 12 is fixed to the trestle 17*g* by bolts, and a mounting base 17*h* is welded to the trestle 17*g*. Further, the compressor body 11 is fixed on the mounting base 17*h* by bolts, and the tank 15 is fixed to the left of the mounting base 17*h* by bolts.

In addition, an operation/stop switch 14*b* and a display 14*c* of the control device 14 are attached to the front panel 17*b*, and the stop valve 18 is attached to the left panel 17*c*.

FIG. 2 is a partial cross-sectional view of the compressor body 11 in the unloaded state, and FIG. 3 is a partial cross-sectional view of the compressor body 11 in a loaded state.

The compressor body 11 includes the cylindrical cylinder 11*a* in which the piston reciprocates and the cylinder head 11*b* attached to the tip of the cylinder 11*a* to suck in air and deliver the compressed air.

The cylinder head 11*b* is provided with an air intake port 11*ba* for taking in air through a filter and an air deliver port 11*bb* for delivering the compressed air, and is fitted with a suction valve 11*bc*, a deliver valve 11*bd*, and an unloader piston 16*c*.

The suction valve 11*bc* is a valve provided between the air intake port 11*ba* and an opening of the cylinder 11*a*, and when the internal pressure of the cylinder 11*a* decreases below the air pressure of the air intake port 11*ba* during the lowering of the piston, the valve opens by the pressure difference, and the air is taken into the cylinder.

The deliver valve 11*bd* is a valve provided between the air deliver port 11*bb* and the opening of the cylinder 11*a*, and when the internal pressure of the cylinder 11*a* rises above the air pressure of the air deliver port 11*bb* during the rise of the piston, the valve opens by the pressure difference, and the compressed air is delivered to the air deliver port 11*bb* side.

The unloader piston 16*c* is a component that forcibly opens the closed suction valve 11*bc* depicted in FIG. 2 and brings the compressor body 11 into the unloaded state as depicted in FIG. 3, and is fixed to the cylinder head 11*b* such that the tip of a protrusion part 16*ca* described later is brought into contact with the suction valve 11*bc*. The unloader piston 16*c* is provided with a pipe connection port for connecting the unloader pipe 16*b*, and the protrusion part 16*ca* for opening the suction valve 11*bc* by protruding by the compressed air flowing in from the pipe connection port.

FIG. 4 is a control circuit diagram of the compressor 10 according to the present embodiment. As depicted in FIG. 4, a control circuit of the compressor 10 is provided with the pressure sensor 15*a* for measuring the pressure in the tank 15, the three-way solenoid valve 16*a* that is a solenoid valve for switching a portion in communication with the unloader pipe 16*b*, the electromagnetic switch 13 for opening and closing a circuit for electrically connecting the power supply AC and the motor 12 to each other, and the control device 14 for controlling the three-way solenoid valve 16*a*, the electromagnetic switch 13, and the like.

The pressure sensor 15*a* is electrically connected to the control device 14, and the pressure value in the tank 15 measured by the pressure sensor 15*a* is transmitted to the control device 14. The three-way solenoid valve 16*a* switches a portion in communication with the unloader pipe 16*b* to the tank 15 or the atmosphere in accordance with a command from the electrically-connected control device 14.

The electromagnetic switch 13 is a device for opening and closing the circuit by the operation of an electromagnet and interrupting the circuit by overload, has a contact 13*a*, a current sensor 13*b*, and a thermal relay 13*c*, and is electrically connected to the control device 14.

The contact 13*a* is a contact part for opening and closing the circuit for electrically connecting the power supply AC and the motor 12 to each other. The contact 13*a* of the present embodiment is an A contact, and is closed in accordance with a command from the control device 14 to start the motor 12.

The current sensor 13*b* is a device for measuring the current that flows when the motor 12 is operated. The measurement value of the current sensor 13*b* is transmitted to the control device 14. It should be noted that the number of phases of the alternate current measured by the current sensor 13*b* may be any number. For example, all the three phases of the three-phase current may be measured, or only one phase may be selected and measured. In general, it is expected to improve the diagnostic accuracy by measuring a two-phase current rather than a one-phase current and a three-phase current rather than a two-phase current. However, as the number of phases is increased, the number of current sensor 13*b* increases, so that the cost increases, and the diagnostic program becomes complicated as well.

The thermal relay 13*c* is a relay for opening and closing the contact by heat generated by a current, in order to protect the motor 12 from overload. In a case where an excessive current flows in the motor 12, the contact is opened in order to prevent the motor 12 from being burned, and the circuit is interrupted (thermal trip).

As described above, the control device 14 is a device for controlling the three-way solenoid valve 16*a*, the electromagnetic switch 13, and the like, and has a control substrate 14*a*, an electronic circuit 14*d*, the operation/stop switch 14*b*, and the display 14*c*.

The control substrate 14*a* is a printed circuit board on which the operation/stop switch 14*b*, the display 14*c*, and the electronic circuit 14*d* are mounted. The operation/stop switch 14*b* is a switch for starting the operation of the motor 12 that is being stopped or stopping the motor 12 that is being operated. The display 14*c* displays characters and images. It is preferable that the display 14*c* display a set pressure or the like or display that there is an abnormality in the power supply system, that there is an abnormality in the compressor body, or the like.

The electronic circuit 14*d* is a component for controlling an electrically-connected device, and includes, for example, ICs (a microcomputer, an FPGA, and the like), electronic components (a resistor, a capacitor, an oscillation circuit, and the like), and power elements (a transistor, a relay, and the like). As depicted in FIG. 4, the pressure sensor 15*a*, the three-way solenoid valve 16*a*, and the electromagnetic switch 13 are electrically connected to the electronic circuit 14*d*, and the motor 12 and the power supply AC are electrically connected to the electronic circuit 14*d* through the electromagnetic switch 13.

Next, contents of the control of the control device 14 will be described.

First, when detecting the operation of an operation button of the operation/stop switch 14*b* in the compressor 10 that is being stopped, the control device 14 controls the electromagnetic switch 13 in such a manner as to bring the contact 13*a* into a contact state in order to start the motor 12.

When the motor 12 is started, the compressor body 11 is operated, and the pressure in the tank 15 rises. When detecting that the pressure value of the tank 15 detected, during the operation of the compressor 10, by the pressure sensor 15*a* exceeds a freely preset upper limit value (stop pressure $P_{off}$), the control device 14 controls either the electromagnetic switch 13 or the three-way solenoid valve 16*a*. Here, the method in which the control device 14 controls the electromagnetic switch 13 is called an intermittent operation control method, and the method in which the control device 14 controls the three-way solenoid valve 16*a* is called a continuous operation control method.

(Intermittent Operation Control Method)

The control device 14 controls the electromagnetic switch 13 in such a manner as to bring the contact 13*a* into a separating state. Accordingly, the power supply to the motor 12 is stopped, the motor 12 is stopped, and the operation of the compressor body 11 is stopped.

After the compressor body 11 is stopped, the compressed air in the tank 15 is consumed by the operation of the apparatus of the customer connected to the stop valve 18.

When detecting that the pressure value of the tank 15 detected, after the motor 12 is stopped, by the pressure sensor 15*a* is below a lower limit value (return pressure $P_{on}$), the control device 14 controls the electromagnetic switch 13 in such a manner as to bring the contact 13*a* into the contact state. Accordingly, the motor 12 starts again, and the compressor body 11 resumes operation.

(Continuous Operation Control Method)

The control device 14 controls the three-way solenoid valve 16*a* in such a manner as to communicate the unloader pipe 16*b* with the tank 15. Accordingly, the compressed air of the tank 15 flows into the unloader pipe 16*b*. The compressed air flowing into the unloader pipe 16*b* presses and protrudes the protrusion part 16*ca* of the unloader piston 16*c* connected to the unloader pipe 16*b*. The protruded protrusion part 16*ca* forcibly opens the suction valve 11*bc* and communicates the inside of the cylinder 11*a* with the atmosphere, the air in the cylinder 11*a* is not delivered from the air deliver port 11*bb* to the tank 15, and the supply of the compressed air to the tank 15 by the compressor body 11 is stopped. Thus, the compressor body 11 stops the supply of the compressed air to the tank 15 without stopping the motor 12 (unload operation).

After the supply of the compressed air to the tank 15 by the compressor body 11 is stopped, air is consumed by the operation of the apparatus of the customer connected to the stop valve 18.

When detecting that the pressure value of the tank 15 detected, after the supply of the compressed air to the tank 15 by the compressor body 11 is stopped, by the pressure sensor 15*a* is below the return pressure $P_{on}$, the control device 14 controls the three-way solenoid valve 16*a* in such a manner as to communicate the unloader pipe 16*b* with the atmosphere.

Accordingly, the pressure of the inside of the unloader pipe 16*b* becomes the atmospheric pressure, the protrusion part 16*ca* of the unloader piston 16*c* does not protrude, and the suction valve 11*bc* is not forcibly opened. Therefore, the supply of the compressed air to the tank 15 by the compressor body 11 is resumed.

This continuous operation control method is used for the purpose of suppressing the repetition of the start of the motor 12 in a case where the start of the motor 12 is repeated and the load of the motor 12 becomes large, for example, in a case where the amount of air delivered from the compressor body 11 is small relative to the amount of air consumed by the apparatus of the customer or in a case where the volume of the tank 15 is small.

It should be noted that the compressor 10 of the present embodiment can use each of the intermittent operation control method and the continuous operation control method. In addition, in the compressor 10 of the present embodiment, it is preferable that the control device 14 automatically switch between the intermittent operation control method and the continuous operation control method according to the start cycle.

Further, when detecting the operation of a stop button of the operation/stop switch 14*b* in the compressor 10 during the operation, the control device 14 controls the electromagnetic switch 13 in such a manner as to bring the contact 13*a* into the separating state in order to stop the motor 12.

Next, the effect of the compressor 10 of the present embodiment will be described.

Figure 5:
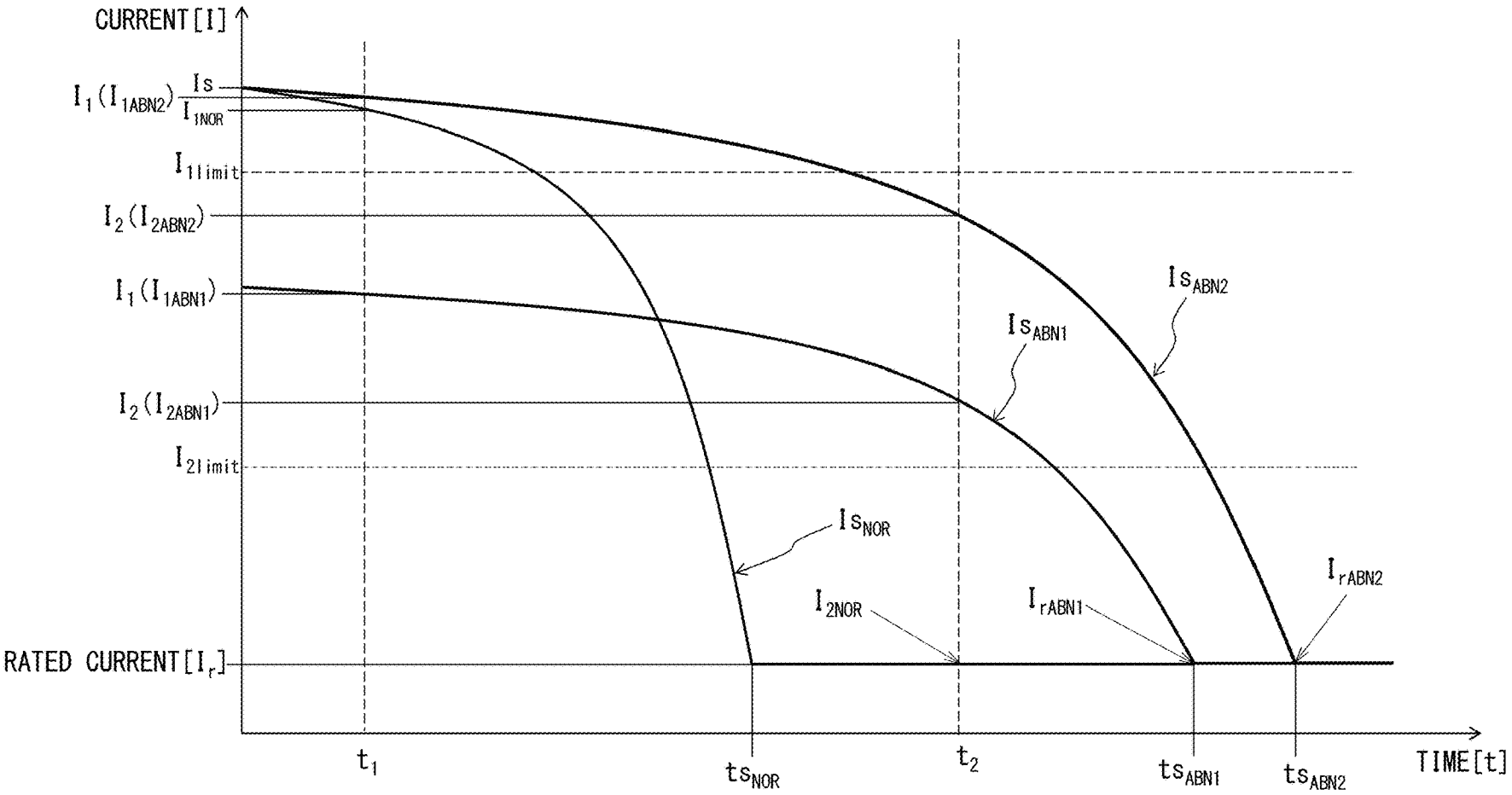
FIG. 5 is a graph for depicting a relation between a starting time and a starting current in a normal condition and an abnormal condition in a motor according to the first embodiment of the present embodiment.

FIG. 5 is a graph for depicting a relation between starting time ts and a starting current Is in the normal condition and the abnormal condition in the motor 12 according to the present embodiment. It should be noted that elapsed time t on the horizontal axis indicates time elapsed from the start of the motor 12, and a current I on the vertical axis indicates an effective value of the current flowing in the motor 12 measured by the current sensor 13*b*. In addition, the starting time ts is time elapsed from the start of the motor 12 until the motor 12 reaches a rated current Ir, and the starting current Is the effective value of the current flowing in the motor 12 at the starting time ts. In addition, a starting current $Is_{NOR}$ indicates the normal condition, and starting currents $Is_{ABN1}$ and $Is_{ABN2}$ indicate the abnormal condition.

Since the compressor 10 is a reciprocating-type compressor, the load torque during one round trip of the piston of the compressor body 11 largely fluctuates. To cope with this, a flywheel is provided at the crankshaft of the compressor body 11 or the output shaft of the motor 12 to increase the moment of inertia, and the unevenness in the rotational speed between the crankshaft and the output shaft caused by the fluctuation of the load torque is smoothed.

However, due to the increase in the moment of inertia, the starting time ts of the motor 12 becomes longer, the starting current Is (larger than the rated current Ir of the motor 12) flows in the motor 12 for a long time, and heat is accumulated in the motor 12. Therefore, every time the number of times of starts of the motor 12 increases, heat is accumulated, and the thermal trip is likely to occur.

Once the thermal trip occurs, the supply of the compressed air is forcibly stopped, and thus, the operating state of a user is seriously affected. Therefore, the compressor 10 of the present embodiment allows the control device 14 to determine a sign of the occurrence of the thermal trip on the basis of the starting time ts and the starting current Is and make a notification.

A curve of the starting current $Is_{NOR}$ in FIG. 5 is an example of a curve obtained in a case where the motor 12 is normal. Here, the control device 14 computes and records, on the basis of the detected value obtained by the current sensor 13*b*, a current value $I_1$ at a point in time when predetermined time (first time $t_1$) has elapsed from the start of the motor 12 and a current value $I_2$ of the motor 12 at a point in time when second time $t_2$ longer than the first time $t_1$ has elapsed from the start of the motor 12.

It should be noted that the first time $t_1$ is preferably immediately after the start (for example, 0.3 seconds), and the second time $t_2$ is preferably sufficient time (for example, three seconds) for the time (normal starting time $ts_{NOR}$) for the motor 12 to reach the rated rotational speed in the normal condition.

As depicted in FIG. 5, in the normal motor 12, a current value $I_{1NOR}$ at the point in time when the first time $t_1$ has elapsed is close to the current value Is obtained at the beginning of the start of the motor 12, and a current value $I_{2NOR}$ at the point in time when the second time $t_2$ has elapsed is almost the same as the rated current value $I_r$ of the motor 12.

The $I_{1NOR}$ and $I_{2NOR}$ are set as normal current values of the motor 12 in the normal condition, and a first threshold value $I_{1limit}$ smaller than the starting current $I_s$ and larger than the rated current Ir and a second threshold value $I_{2limit}$ smaller than the first threshold value $I_{1limit}$ and larger than the rated current $I_r$ are defined as threshold values considering variations such as individual differences of the compressor 10.

Next, a case in which it is determined that there is an abnormality in the power supply system for supplying electricity to the compressor 10 will be described. A curve of the starting current $Is_{ABN1}$ in FIG. 5 is an example of a curve obtained in a case where there is an abnormality in the power supply system of the motor 12.

The abnormality of the power supply system may be, for example, insufficient capacity of a power transformer, an excessive or insufficient wiring length, coincidence of the start timing with other apparatuses sharing the power supply AC, and in this case, the supply voltage of the motor 12 decreases.

Since the starting current $I_s$ of the motor 12 is proportional to the voltage, the starting current $Is_{ABN1}$ in a case where there is an abnormality in the power supply system is lower than the starting current $Is_{NOR1}$ in the normal condition at the beginning of start as depicted in FIG. 5. As a result, since the starting torque of the motor 12 decreases, the starting time $t_{SABN1}$ at which the motor 12 reaches the rated rotational speed and the current decreases to the rated value $I_r$ becomes longer than the starting time $ts_{NOR}$ in the normal condition.

At this time, in a case where the following equation (1) is established for the current value $I_1$ ($I_{1ABN1}$) obtained at the point in time when the first time $t_1$ has elapsed from the start of the motor 12 and the current value $I_2$ ($I_{2AbN1}$) obtained at the point in time when the second time $t_2$ has elapsed from the start of the motor 12, a notification of an abnormality in the power supply system is made by, for example, display of the display 14*c*. It should be noted that this notification is different from the mode of a notification in a case where an equation (2) described later is established.

$$I_1 < I_{1limit} \text{ and } I_2 > I_{2limit} \tag{1}$$

The equation (1) represents a case in which, as a result of the insufficient starting current due to a voltage drop of the power supply AC, it takes a long time for starting and the current $I_2$ ($I_{2ABN1}$) of the motor 12 has not decreased to the rated value $I_r$ at the point in time when the second time $t_2$ has elapsed. In this case, the starting current $Is_{ABN1}$ larger than the rated current Ir of the motor 12 flows in the motor 12 for the starting time $t_{SABN1}$ longer than the second time $t_2$, and heat is accumulated in the motor 12. Therefore, since the thermal trip is likely to occur, it is preferable that the compressor 10 of the present embodiment determine the flow of the starting current $Is_{ABN1}$ in the motor 12 for the starting time $t_{SABN1}$ as a sign of the occurrence of the thermal trip and notify that there is an abnormality in the power supply system. Accordingly, it is possible to perform maintenance processing for the abnormality in the power supply system before the occurrence of the thermal trip, and the influence of the occurrence of the thermal trip on the operating state of the user can be suppressed.

Next, a case in which it is determined that there is an abnormality in the compressor 10 will be described. A curve of the starting current $Is_{ABN2}$ in FIG. 5 is an example of a curve obtained in a case where there is an abnormality in the compressor 10. In a case where there is an abnormality in the compressor 10, for example, there is a deterioration in the sealing performance of the deliver valve 11*bd* or an abnormality in the drive system.

The deterioration in the sealing performance of the deliver valve 11*bd* is caused by breakage or corrosion of the deliver valve 11*bd*, or the occurrence of biting of a foreign object. In this case, the compressed gas leaks into the cylinder 11*a* to raise the internal pressure of the cylinder 11*a* during the stop of the compressor 10. Therefore, the torque required for starting increases, and starting time $ts_{ABN2}$ becomes longer than the starting time $ts_{NOR}$ in the normal condition as depicted in FIG. 5.

In addition, the abnormality caused by the drive system occurs due to a failure or the like of a bearing for supporting the crankshaft of the compressor body 11 or the output shaft of the motor 12. In this case, the torque required for starting increases, and the starting time $ts_{ABN2}$ becomes longer than the starting time $ts_{NOR}$ in the normal condition as depicted in FIG. 5.

At this time, in a case where the following equation (2) is established for the current value $I_1$ ($I_{1ABN2}$) obtained at the point in time when the first time $t_1$ has elapsed from the start of the motor 12 and the current value $I_2$ ($I_{2ABN2}$) obtained at the point in time when the second time $t_2$ has elapsed from the start of the motor 12, a notification of an abnormality in the compressor 10 is made by, for example, display of the display 14*c*. It should be noted that this notification is made by a mode different from that of the case where the above-described equation (1) is established, for example, by display of the display 14*c* different from that of the case where the equation (1) is established.

$$I_1 > I_{1limit} \text{ and } I_2 > I_{2limit} \quad (2)$$

The equation (2) indicates a state in which there is no abnormality in the power supply system and the current value $I_1$ ($I_{1ABN2}$) at the point in time when the first time $t_1$ has elapsed from the start of the motor 12 is close to the current value Is obtained at the beginning of the start of the motor 12 but in which the starting time $ts_{ABN2}$ is long and the current value $I_2$ ($I_{2ABN2}$) of the motor 12 at the point in time when the second time $t_2$ longer than the first time $t_1$ has elapsed has not decreased to the rated value $I_r$.

In this case, the starting current $Is_{ABN2}$ larger than the rated current Ir of the motor 12 flows in the motor 12 for the starting time $ts_{ABN2}$ longer than the second time $t_2$, and heat is accumulated in the motor 12. Therefore, since the thermal trip is likely to occur, it is preferable that the compressor 10 of the present embodiment determine the flow of the starting current $Is_{ABN2}$ in the motor 12 for the starting time $ts_{ABN2}$ as a sign of the occurrence of the thermal trip and notify that there is an abnormality in the compressor 10. Accordingly, it is possible to perform maintenance processing for the abnormality of the compressor 10 before the occurrence of the thermal trip, and the influence of the occurrence of the thermal trip on the operating state of the user can be suppressed.

In addition, as described above, the control device 14 makes a notification in a different mode between the case where the equation (1) is established and the case where the equation (2) is established. Accordingly, the abnormality of the compressor can be discriminated from the abnormality of the power supply system, and the man-hours required for maintenance can be suppressed.

Second Embodiment

Figure 6:
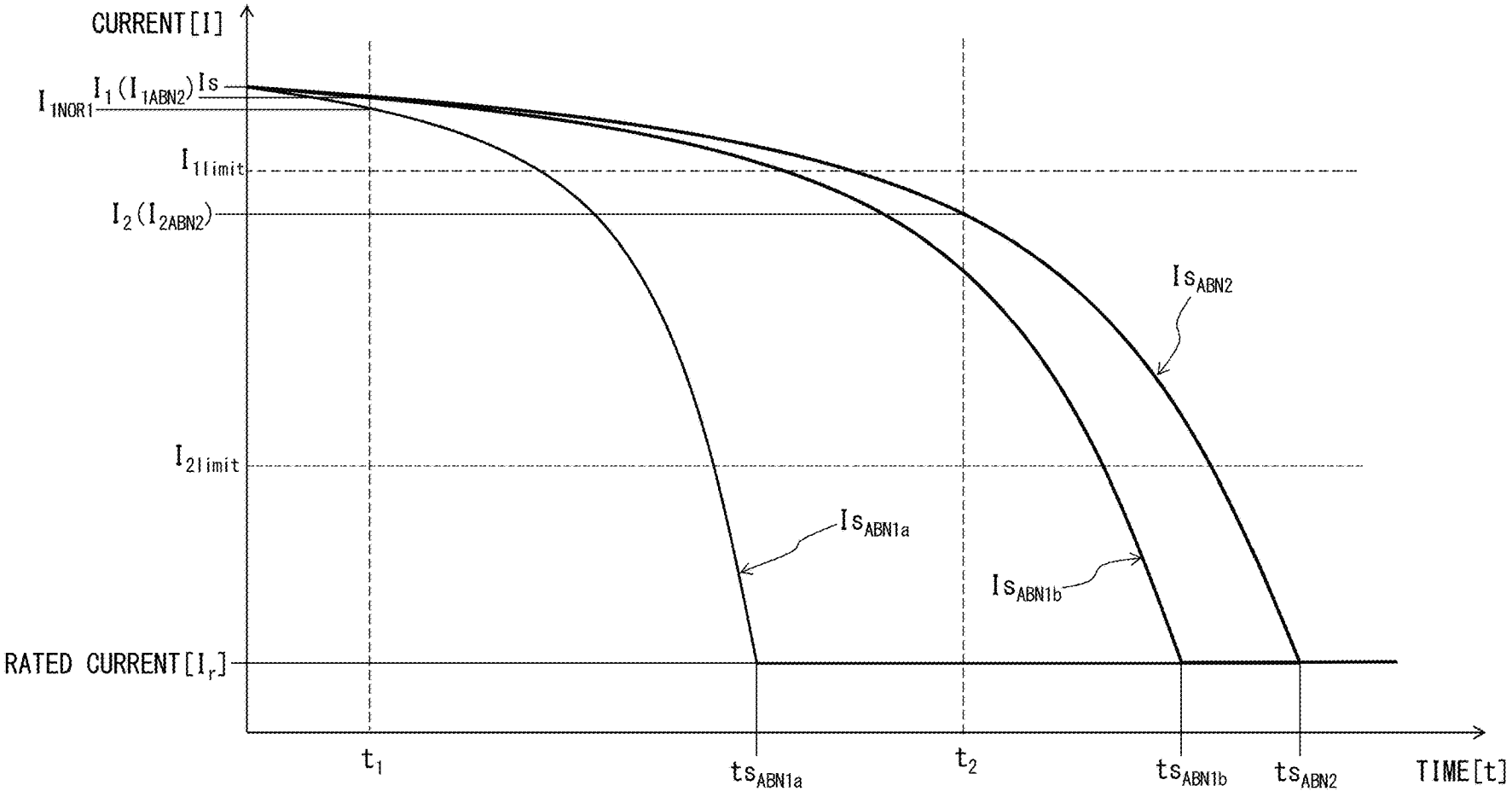
FIG. 6 is a graph for depicting a relation between a starting time and a starting current in an abnormal condition in a motor according to a second embodiment of the present embodiment.

FIG. 6 is a graph for depicting a relation between starting time ts and a starting current Is in the abnormal condition in a compressor according to the second embodiment of the present invention. As in FIG. 5, the elapsed time t on the horizontal axis indicates the time elapsed from the start of the motor 12, and the current I on the vertical axis indicates the effective value of the current flowing in the motor 12 measured by the current sensor 13*b*. In addition, the starting time ts is the time elapsed from the start of the motor 12 until the motor 12 reaches the rated current Ir, and the starting current Is the effective value of the current flowing in the motor 12 at the starting time ts.

In addition, the starting current $Is_{ABN1a}$ is a curve indicating the starting current flowing in the motor 12 in a case where the compressor in which an abnormality occurs due to the deterioration of the sealing performance of the deliver valve 11*bd* is unloaded and started. The starting current $Is_{ABN1a}$ is a curve indicating the starting current flowing in the motor 12 in a case where the compressor in which an abnormality occurs due to the deterioration of the sealing performance of the deliver valve 11*bd* is loaded and started. $Is_{ABN2}$ is a curve indicating the starting current flowing in the motor 12 in a case where the compressor in which an abnormality occurs due to the drive system of the compressor body 11 is unloaded and started.

The compressor according to the present embodiment differs from the compressor 10 according to the first embodiment in that the compressor body 11 is started by an unloaded operation (unloaded start) by the unloader device 16 for predetermined time (for example, approximately one second) from the start. Under such control, the starting load can be reduced, and the starting time ts can be shortened.

In this case, even if an abnormality of the compressor due to the deterioration of the sealing performance occurs in the deliver valve 11*bd*, the starting load is reduced by the unloaded operation. As a result, as depicted by the curve of the starting current $Is_{ABN1a}$ in FIG. 6, the equation (2) is not established, and the abnormality cannot be detected.

On the other hand, the purpose of performing the unloaded start in the compressor according to the present embodiment is to reduce the starting load. Therefore, even if the compressor is started without performing the unloaded start (the compressor performs a loaded start to be started), the result is only that the starting load is not reduced, and the thermal trip is less likely to occur immediately by a single loaded start.

Therefore, in the compressor, for example, the loaded start is performed periodically such that only one loaded start out of 20 starts is performed, and the presence or absence of an abnormality at the unloaded start and the loaded start is detected.

At this time, the abnormality caused by the deterioration of the sealing performance of the deliver valve 11*bd*, for which the equation (2) is not established at the unloaded start and the abnormality cannot be detected, establishes the equation (2) as depicted by the curve of the starting current $Is_{ABN1b}$ in FIG. 6 at the loaded start.

On the other hand, the current value $I_1$ and the current value $I_2$ at the time of unloading and starting the compressor in which an abnormality occurs due to the drive system of the compressor body 11 establish the equation (2) as depicted by the curve of the starting current $Is_{ABN2}$ in FIG. 6. In addition, the current value $I_1$ and the current value $I_2$ at the time of loading and starting the compressor in which an abnormality occurs due to the drive system of the compressor body 11 establish the equation (2) as depicted by the curve of the starting current $Is_{ABN2}$ in FIG. 5.

Accordingly, in a case where there is an abnormality in the compressor, the compressor of the present embodiment can discriminate an abnormality due to the deterioration of the sealing performance of the deliver valve 11*bd* from an abnormality due to the drive system of the compressor body 11.

Effect

The compressor of the present embodiment further has the unloader device 16 for reducing the starting load of the compressor body 11 in accordance with a command from the control device 14, and in a case where the equation (2) is established when the unloader device 16 is not activated at the time of starting the compressor body 11 and the equation (2) is not established when the unloader device 16 is activated at the time of starting the compressor body 11, it is preferable that the control device 14 make a notification of an abnormality in the deliver valve 11*bd* of the compressor by, for example, display of the display 14*c*. It should be noted that the notification is preferably a notification in a mode different from that of the notification in the first embodiment.

Accordingly, it is possible to specify an abnormality of the compressor as an abnormality due to the deterioration of the sealing performance of the deliver valve 11*bd* and perform maintenance processing before the occurrence of the thermal trip, and thus, the man-hours required for maintenance can be reduced.

In addition, in a case where the equation (2) is established when the compressor body 11 is started without activating the unloader device 16 and the equation (2) is established when the unloader device 16 is activated and the compressor body 11 is started, it is preferable that the control device 14 of the present embodiment make a notification of an abnormality due to the drive system of the compressor body 11 by, for example, display of the display 14*c*.

Accordingly, it is possible to specify an abnormality of the compressor as an abnormality due to the drive system and perform maintenance processing before the occurrence of the thermal trip, and thus, the man-hours required for maintenance can be reduced.

Third Embodiment

A compressor according to the third embodiment differs from the compressor 10 according to the first embodiment in that a notification is made in a case where the ratio of the number of times the equation (1) or the equation (2) is established to the number of times of starts of the motor 12 exceeds a predetermined value.

The equation (2) may be established even in a case where the abnormality of the compressor is a transient abnormality, for example, a small foreign object is bitten in the deliver valve 11*bd*. However, in a case where a small foreign object is bitten in the deliver valve 11*bd*, the foreign object may fall off from the deliver valve 11*bd* and naturally disappear while the deliver valve 11*bd* opens and closes. In addition, the equation (1) is established even in a case where the abnormality of the power supply system is accidental, for example, in a case where the start of another apparatus accidentally coincides with the start of the compressor and the voltage drops.

Maintenance processing is not required for these abnormalities, and when a notification is made due to these abnormalities, maintenance processing is performed on the basis of the notification, and the man-hours spent for the maintenance processing are wasted.

In consideration of the cases where the man-hours spent for the maintenance processing are wasted as described above, in a case where the ratio of the number of times the equation (1) or the equation (2) is established to the number of times of starts of the motor 12 exceeds a predetermined value, the compressor according to the present embodiment makes a notification of the fact by, for example, display of the display 14*c*. Accordingly, it is possible to suppress the control device from making a notification of an abnormality that does not require maintenance processing, for example, a transient abnormality or an accidental abnormality, and thus, it is possible to suppress the man-hours spent for maintenance processing on the basis of the notification from being wasted.

Fourth Embodiment

Figure 7:
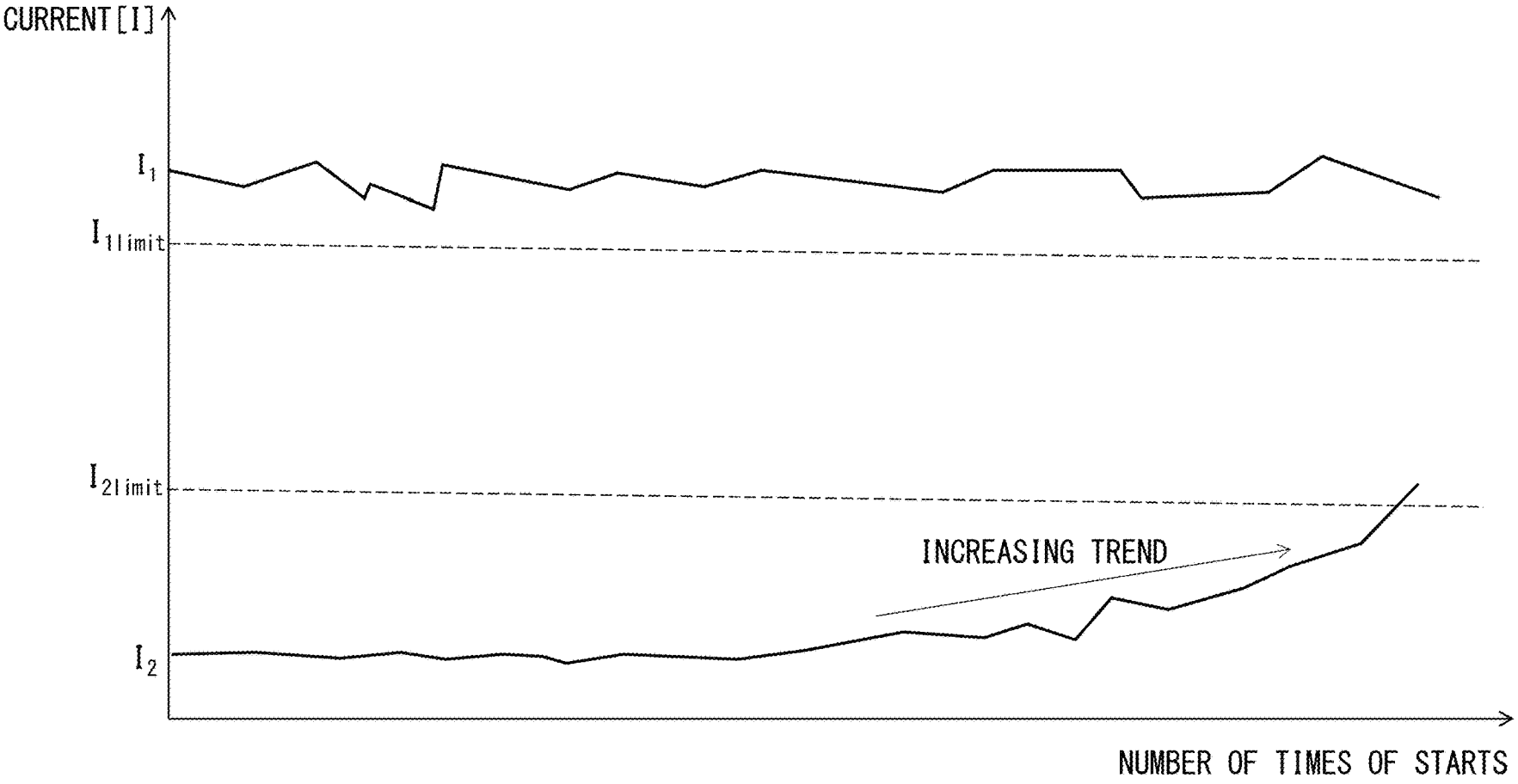
FIG. 7 is a graph for depicting a relation between a starting current and the number of times of starts of a motor according to a fourth embodiment of the present invention.

FIG. 7 is a graph for depicting a relation between the number of times of activating a compressor and a starting current according to the fourth embodiment of the present invention. The compressor according to the present embodiment differs from the compressor 10 according to the first embodiment in that the control device 14 detects and makes a notification of a progressive abnormality.

The progressive abnormality is, for example, breakage or corrosion of the deliver valve 11*bd*. The breakage or corrosion of the deliver valve 11*bd* is not a transient abnormality as in the case where a foreign object is caught in the deliver valve 11*bd*, and worsens over time. There is a risk that such a progressive abnormality leads to the occurrence of the thermal trip without establishing the equations (1) and (2).

Therefore, the compressor according to the present embodiment allows the control device 14 to detect such a progressive abnormality and make a notification of it by, for example, display of the display 14*c*.

As depicted in FIG. 7, in a case where there is a progressive abnormality, the current value $I_2$ tends to increase as the abnormality progresses. For example, in the case of corrosion of the deliver valve 11*bd*, the amount of leakage of the compressed air into the cylinder 11*a* increases when the compressor stops due to the progress of the corrosion, and the starting time is extended, so that the current value $I_2$ increases as the abnormality progresses.

Therefore, it is preferable that the control device of the compressor according to the present embodiment record the current value (for example, the current value $I_2$) of the motor 12 at a point in time when predetermined time (for example, the second time $t_2$) has elapsed from the start of the motor 12, through the current sensor 13*b* every time the motor 12 is started and make a notification by, for example, display of the display 14*c* in a case where the current value $I_2$ of the motor 12 at the point in time when the predetermined time $t_2$ has elapsed from the start of the motor 12 increases together with an increase in the number of times of starts of the motor 12.

For example, the control device 14 reads data regarding the current values $I_1$ and $I_2$ obtained before a point in time when the equations (1) and (2) are established, from the storage device for a predetermined period (for example, one month) or a predetermined number of times of starts (for example, 10,000 times), detects a progressive abnormality in a case where an increasing trend is recognized in the current value $I_2$, and makes a notification of it by, for example, display of the display 14*c*.

For example, as the determination of the presence or absence of the increasing trend, the current values $I_1$ and $I_2$ in FIG. 7 are linearly approximated, and in a case where the inclinations thereof are equal to or larger than a predetermined value, it is determined that there is an increasing trend. Alternatively, the value of a correlation coefficient r is obtained from the variation in the data regarding the current values $I_1$ and $I_2$, and in a case where the value is equal to or larger than a predetermined value, it is determined that there is an increasing trend.

Effect

It is preferable that the control device of the compressor according to the present embodiment record the current value (for example, the current value $I_2$) of the motor 12 at a point in time when predetermined time has elapsed from the start of the motor 12, through the current sensor 13*b* every time the motor 12 is started and make a notification in a case where the current value $I_2$ of the motor 12 at the point in time when the predetermined time has elapsed from the start of the motor 12 increases together with an increase in the number of times of starts of the motor 12.

Accordingly, it is possible to perform maintenance processing for the progressive abnormality before the thermal trip occurs due to the progressive abnormality, and the influence of the occurrence of the thermal trip on the operating state of the user can be suppressed.

Fifth Embodiment

In a case where the motor 12 is started threshold value $N2_{limit}$ times or more within predetermined time for the start and stop of the motor 12 that is usually repeated in a short period of time, a notification of the risk that the thermal trip occurs is made by, for example, display of the display 14*c*. However, since the number of threshold value $N2_{limit}$ times is set in consideration of the time ts during which the starting current $I_s$ flows in the normal condition, it cannot be applied to a compressor having a minor abnormality.

Specifically, since the time ts during which the starting current $I_s$ flows increases in the compressor having a minor abnormality, the amount of heat accumulated in a single start increases with the increase of the time ts, and even if the number of starts of the motor is less than that in the normal condition, there is a risk that the thermal trip occurs. Therefore, there is a possibility that the thermal trip occurs due to the heat accumulation of the thermal relay 13*c* when the motor 12 is started the threshold value $N2_{limit}$ times or less and none of the equations (1) and (2) is established.

Therefore, according to the present invention, the threshold value $N2_{limit}$ is changed in such a manner as to be proportional to the inverse of the current value I (for example, the current value $I_2$) obtained at a point in time when predetermined time (for example, the second time $t_2$) has elapsed from the start of the motor 12, as depicted in the following equation.

$$N \propto 1/I \tag{3}$$

That is, the compressor according to the present embodiment makes a notification of the number of times of starts of the compressor in which the thermal trip is likely to occur, as the number N of times of starts of the compressor inversely proportional to the current value I of the motor 12, by, for example, display of the display 14*c* so as not to start more than the number of times of starts.

Effect

It is preferable that the control device 14 of the compressor according to the present embodiment measure, through the current sensor 13*b*, the current value (for example, the current value $I_2$) of the motor 12 at point in time when predetermined time (for example, the second time $t_2$) has elapsed from the start of the motor 12 and make a notification in a case where the motor 12 is started N times or more represented by the following equation (3) within predetermined time (for example, the second time $t_2$).

$$N \propto 1/I \tag{3}$$

Accordingly, it is possible to perform maintenance processing before the occurrence of the thermal trip due to the start and stop repeated in a short period of time in the compressor having a minor abnormality, and the influence of the occurrence of the thermal trip on the operating state of the user can be suppressed.

It should be noted that the present invention is not limited to the above-described embodiments, and includes various modified examples. For example, the above-described embodiments have been described in detail for the purpose of clearly explaining the present invention, and are not necessarily limited to those having all the described configurations. In addition, it is possible to replace a part of a configuration of one embodiment with a configuration of another embodiment, and it is also possible to add a configuration of one embodiment to a configuration of another embodiment. In addition, for a part of a configuration in each embodiment, another configuration can be added, deleted, or replaced with.

In addition, some or all of the above configurations, functions, and the like may be realized by hardware such as designing with, for example, an integrated circuit. In addition, the above configurations, functions, and the like may be realized by software by a processor (microcomputer) interpreting and executing a program for realizing each function. Information such as programs, tables, and files that realize each function can be placed in a memory, a recording device such as a hard disk or an SSD (Solid State Drive), or a recording medium such as an IC card, an SD card, or a DVD.

It should be noted that the embodiments of the present invention may have the following configurations. For example, the compressor 10 has been described as a reciprocating-type compressor in the above embodiments, but is not limited thereto, and may be a compressor of a screw type or a scroll type, for example, or a booster compressor or the like that is supplied with primary pressure from the outside and recompresses.

In addition, the gas to be compressed has been described as air, but is not limited thereto, and may be other gas such as nitrogen gas, or water or other liquid.

In addition, in the above-described embodiments, the suction valve open-type unload method is used for the unloader device 16, but is not limited thereto. For example, a method of blocking a suction flow path such that air cannot flow in the cylinder or a method of opening a deliver flow path to the atmosphere may be used.

In addition, a method of operating the electromagnetic switch 13 on the basis of the detected value obtained by the pressure sensor 15*a* for the control of the drive of the motor 12 has been described above, but is not limited thereto. For example, a method of operating the electromagnetic switch 13 by the output of a pressure switch provided in the tank 15 instead of the pressure sensor 15*a*, or a method using a push-button switch with a thermal relay instead of the electromagnetic switch 13 may be used.

In addition, a notification of an abnormality in the power supply system, an abnormality in the compressor body, or the like is made by the display 14*c* in the above-described embodiments, but is not limited thereto. For example, the notification may be made by a lamp or a buzzer.

DESCRIPTION OF REFERENCE CHARACTERS

10: Compressor
11: Compressor body
11*a*: Cylinder
11*b*: Cylinder head
11*ba*: Air intake port
11*bb*: Air deliver port
11*bc*: Suction valve
11*bd*: Deliver valve
12: Motor
13: Electromagnetic switch
13*a*: Contact
13*b*: Current sensor
13*c*: Thermal relay
14: Control device
14*a*: Control substrate
14*b*: Operation/stop switch
14*c*: Display
14*d*: Electronic circuit
15: Tank
15*a*: Pressure sensor
16: Unloader device
16*a*: Three-way solenoid valve
16*b*: Unloader pipe
16*c*: Unloader piston

The invention claimed is:

1. A compressor comprising:

a compressor body that compresses gas;

a motor that drives the compressor body;

a control device that controls the motor; and a current sensor that detects a current value of the motor, wherein the control device is configured to:

compute, through the current sensor, a current value $I_1$ of the motor at a point in time when a first time has elapsed from a start of the motor and a current value $I_2$ of the motor at a point in time when a second time, longer than the first time, has elapsed from the start of the motor, and make a first notification corresponding to a first mode in a case where a following equation (1) is established, and make a second notification corresponding to a second mode in a case where a following equation (2) is established for a first threshold value $I_{1limit}$ that is smaller than a current value obtained at the start of the motor and larger than a rated current value of the motor and a second threshold value $I_{2limit}$ that is smaller than the first threshold value $I_{1limit}$ and larger than the rated current value of the motor, wherein equation (1) and equation (2) are as follows:

$$I_1 < I_{1limit} \text{ and } I_2 > I_{2limit} \quad (1)$$

$$I_1 > I_{1limit} \text{ and } I_2 > I_{2limit}. \quad (2)$$

2. The compressor according to claim 1, wherein the control device is configured to notify that there is an abnormality in a power supply system, in the case where the equation (1) is established.

3. The compressor according to claim 1, wherein the control device is configured to notify that there is an abnormality in the compressor, in the case where the equation (2) is established.

4. The compressor according to claim 3, further comprising:

an unloader device that reduces a starting load of the compressor body in accordance with a command from the control device, wherein the control device is configured to notify that there is an abnormality in a deliver valve of the compressor, in the case where the equation (2) is established when the unloader device is not activated at the start of the compressor body and in a case where the equation (2) is not established when the unloader device is activated at the start of the compressor body.

5. The compressor according to claim 1, wherein the control device is configured to make a third notification in a case where a ratio of a number of times the equation (1) or the equation (2) is established to a number of times of starting of the motor exceeds a predetermined value.

* * * * *